US012024870B2

(12) United States Patent
Wang et al.

(10) Patent No.: US 12,024,870 B2
(45) Date of Patent: Jul. 2, 2024

(54) SELF-LOCKING WATER LEVEL ADJUSTING MECHANISM

(71) Applicant: HUIDA SANITARY WARE CO., LTD., Tangshan (CN)

(72) Inventors: Yanqing Wang, Tangshan (CN); Taotao Yu, Tangshan (CN); Haichang Sun, Tangshan (CN)

(73) Assignee: HUIDA SANITARY WARE CO., LTD., Tangshan (CN)

( * ) Notice: Subject to any disclaimer, the term of this patent is extended or adjusted under 35 U.S.C. 154(b) by 71 days.

(21) Appl. No.: 18/091,407

(22) Filed: Dec. 30, 2022

(65) Prior Publication Data

US 2023/0137984 A1 May 4, 2023

Related U.S. Application Data

(63) Continuation of application No. PCT/CN2021/141971, filed on Dec. 28, 2021.

(30) Foreign Application Priority Data

Dec. 29, 2020 (CN) ..... 202011596667.4

(51) Int. Cl.
*E03D 1/34* (2006.01)

(52) U.S. Cl.
CPC ..... *E03D 1/34* (2013.01)

(58) Field of Classification Search
CPC ..... E03D 1/34
See application file for complete search history.

(56) References Cited

FOREIGN PATENT DOCUMENTS

| | | | |
|---|---|---|---|
| CN | 203531093 | U | 4/2014 |
| CN | 204456351 | U | 7/2015 |
| CN | 205935105 | U | 2/2017 |
| CN | 210134495 | U | 3/2020 |
| CN | 112627299 | A | 4/2021 |
| CN | 214143965 | U | 9/2021 |
| WO | 2017108188 | A1 | 6/2017 |

OTHER PUBLICATIONS

International Search Report issued in corresponding International application No. PCT/CN2021/141971, mailed Mar. 14, 2022.
Written Opinion of the International Searching Authority for No. PCT/CN2021/141971.

*Primary Examiner* — Christine J Skubinna

(57) ABSTRACT

A self-locking water level adjusting mechanism includes a partition plate, an adjusting clamping structure arranged on one side of the partition plate, and an adjusting lock. The adjusting clamping structure is slidably connected with the partition plate in a vertical direction. The adjusting lock is elastically connected with the partition plate through an elastic piece. The adjusting lock is clamped with the adjusting clamping structure under restoring force of the elastic piece.

10 Claims, 5 Drawing Sheets

SELF-LOCKING WATER LEVEL ADJUSTING MECHANISM

CROSS-REFERENCE TO RELATED APPLICATION

The present disclosure claims foreign priority to Chinese Patent Application No. CN202011596667.4, filed on Dec. 29, 2020 in the State Intellectual Property Office of China, and the entire contents of which is hereby incorporated by reference.

TECHNICAL FIELD

The present disclosure relates to a technical field of drain valves of toilet water tanks, and in particular to a self-locking water level adjusting mechanism.

BACKGROUND

A volume of water drained from internal chambers of conventional drain valves is generally adjusted by controlling a size of openings on the conventional drain valves. As shown in FIG. 1, which discloses a drain valve having a drainage hole defined on one side of a drain chamber of the drain valve and a plurality of clamping teeth arranged on two sides of the drainage hole. A clamping plate defining two elastic arms is mounted in the drainage hole. The two elastic arms are cantilever-shaped. The elastic arms are fastened in the clamping teeth on the two sides of the drainage hole. When a drainage amount of the drain valve needs to be adjusted, a certain force is applied to the clamping plate, causing elastic deformation of the elastic arms, so that the clamping plate is released from the clamping teeth on the two sides of the drainage hole, and a position of the clamping plate in the drainage hole is changed. Therefore, a volume of the clamping plate in the drainage hole is changed accordingly. Due to the change of the volume of the clamping plated in the drainage hole, a flowing speed and time of the water in the drain chamber of the drain valve changes accordingly, thus affecting a falling speed and time of a float in the drain chamber, and finally leading to changes in the volume of water drained from the drain valve.

However, there are some defects in actual use. Fit between the elastic arms of the clamping plate and the clamping teeth of the drainage hole cannot be too tight, otherwise the elastic arms are hardly pushed, which further make it difficult to adjust the relative position of the clamping plate and the drainage hole; nor can the fit between the elastic arms and the clamping teeth be too loose, otherwise the clamping plate is easy to loosen and unable to be locked in the drainage hole to adjust the relative position of the clamping plate and the drainage hole. Further, a specific height of the drain valve generally needs to be adjusted in advance before sending to a user. In a process of transportation or under an action of external force, the clamping plate may slide with respect to the drainage hole, causing a change of the relative position of the clamping plate and the drainage hole, so that a drainage volume is changed. If the drainage volume is large, a waste of water is caused, and if the drainage volume is small, the flushing effect on the toilet is affected.

SUMMARY

The technical problems to be solved by the present disclosure are to overcome defects of the prior art and provide a self-locking water level adjusting mechanism that is small in size and easy to adjust.

The present disclosure provides a self-locking water level adjusting mechanism. The self-locking water level adjusting mechanism comprises a partition plate, an adjusting clamping structure arranged on one side of the partition plate, and an adjusting lock. The adjusting clamping structure is slidably connected with the partition plate in a vertical direction. The adjusting lock is elastically connected with the partition plate through an elastic piece. The adjusting lock is clamped with the adjusting clamping structure under restoring force of the elastic piece.

Optionally, in one embodiment, the partition plate comprises a vertical plate. The vertical plate defines a drainage hole. The vertical plate defines clamping grooves above the drainage hole. The adjusting clamping structure is of a U-shaped structure. The adjusting clamping structure comprises an adjusting plate and an elastic arm. The adjusting plate and the elastic arm are integrally formed. Sliding buckles are arranged on an inner wall of the adjusting plate along the vertical direction. The sliding buckles of the adjusting plate are clamped in the clamping grooves under restoring force of the elastic arm.

Optionally, in one embodiment, the vertical plate defines a fixed hole. The adjusting lock comprises two clamping buckles arranged opposite to each other. The clamping buckles are snapped on a position of the fixed hole, so the adjusting lock is connected with the vertical plate.

Optionally, in one embodiment, the elastic piece comprises two elastic sheets arranged opposite to each other. A first end of each of the elastic sheets is fixedly connected with the adjusting lock. A second end of each of the elastic sheets abuts against a corresponding side of the fixed hole of the vertical plate.

Optionally, in one embodiment, the adjusting clamping structure comprises clamping teeth arranged along the vertical direction. The adjusting lock comprises locking teeth matched with a shape of the clamping teeth. The locking teeth of the adjusting lock are engaged with the clamping teeth of the adjusting clamping structure under the restoring force of the elastic piece.

Optionally, in one embodiment, a vertical cross-section of each of the clamping grooves and a vertical cross-section of each of the sliding buckles are trapezoidal. The clamping grooves and the sliding buckles define inclined surfaces. The inclined surfaces of the clamping grooves are matched with the inclined surfaces of the sliding buckles.

Optionally, in one embodiment, an angle between each of the inclined surfaces of the clamping grooves and a vertical plane is greater than 90 degrees. An angle between each of the inclined surfaces of the sliding buckles and the vertical plane is greater than 90 degrees.

Optionally, in one embodiment, an upper frame is sleeved on the partition plate. The upper frame defines an adjusting opening corresponding to a position of the adjusting clamping structure and a locking opening corresponding to a position of the adjusting lock.

Optionally, in one embodiment, an outer end of the adjusting lock passes through the locking opening and extends outward. A distance between the outer end of the adjusting lock and an outer surface of the upper frame is less than a depth of each of the clamping teeth.

Optionally, in one embodiment, a handheld surface is defined on a lower portion of an outer surface of the adjusting clamping structure.

A structure design of the self-locking water level adjusting mechanism of the present disclosure is scientific and reasonable, making it easy to operate and stable in performance. In absence of external force, the adjusting lock and the adjusting clamping structure are in a locked state, so that the adjusting clamping structure is always in a predetermined position and is unable to be released from the adjusting lock to slide, avoiding displacement of the adjusting clamping structure during non-manipulated use, work, and transportation, and ensuring that a drainage volume of a drain valve does not change.

1—partition plate; 1.1—drainage hole; 1.2—clamping groove; 1.3—vertical plate; 1.4—fixed hole; 2—adjusting clamping structure; 2.1—elastic arm; 2.2—sliding buckle; 2.3—clamping tooth; 3—adjusting lock; 3.1—elastic sheet; 3.2—locking tooth; 3.3—clamping buckle; 4—upper frame.

DETAILED DESCRIPTION

In order to enable those skilled in the art to understand technical solutions of the present disclosure, the following further describes the present disclosure in detail with reference to accompanying drawings and optional embodiments.

Figure 1:
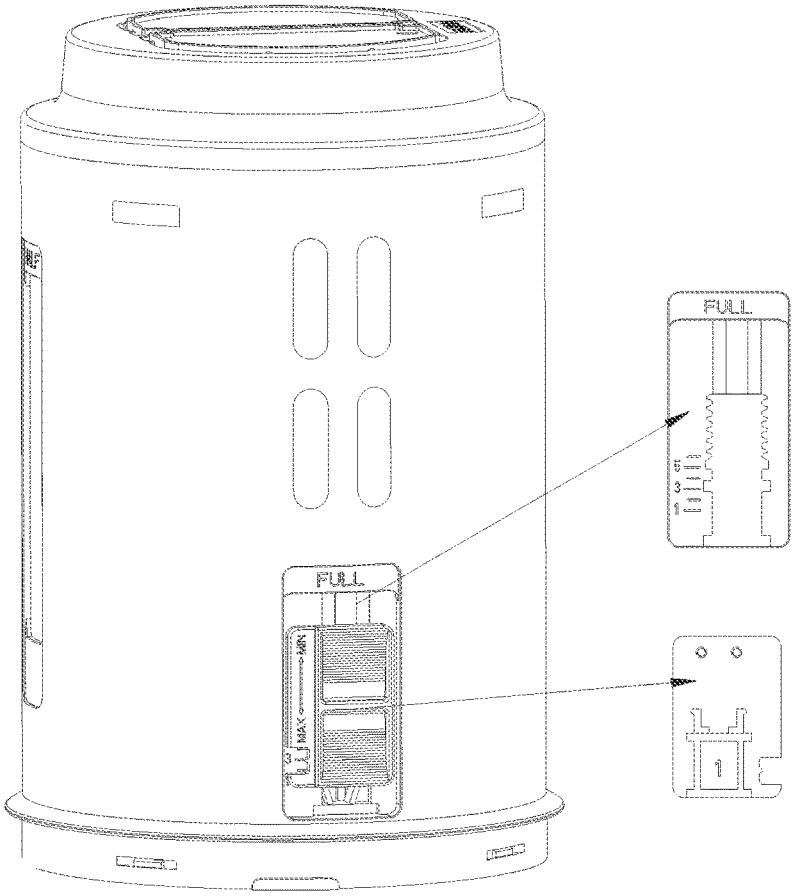
FIG. 1 Prior art
FIG. 1 is a perspective schematic diagram of a drain valve in the prior art.
Figure 2:
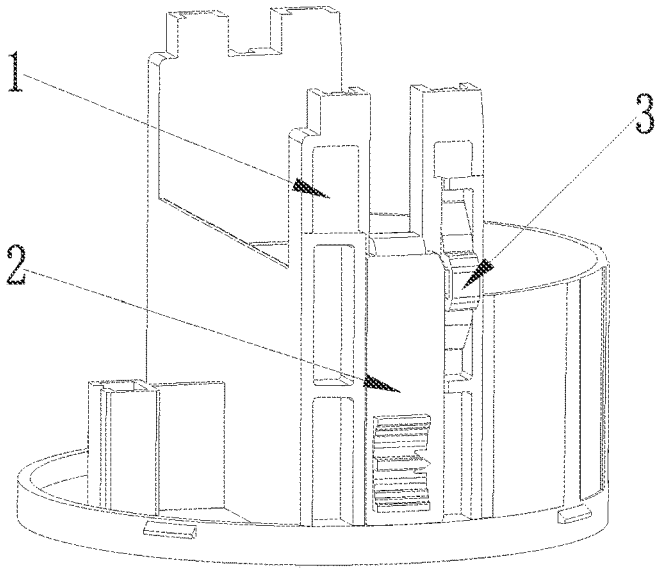
FIG. 2 is a perspective schematic diagram of a self-locking water level adjusting mechanism of the present disclosure.
Figure 3:
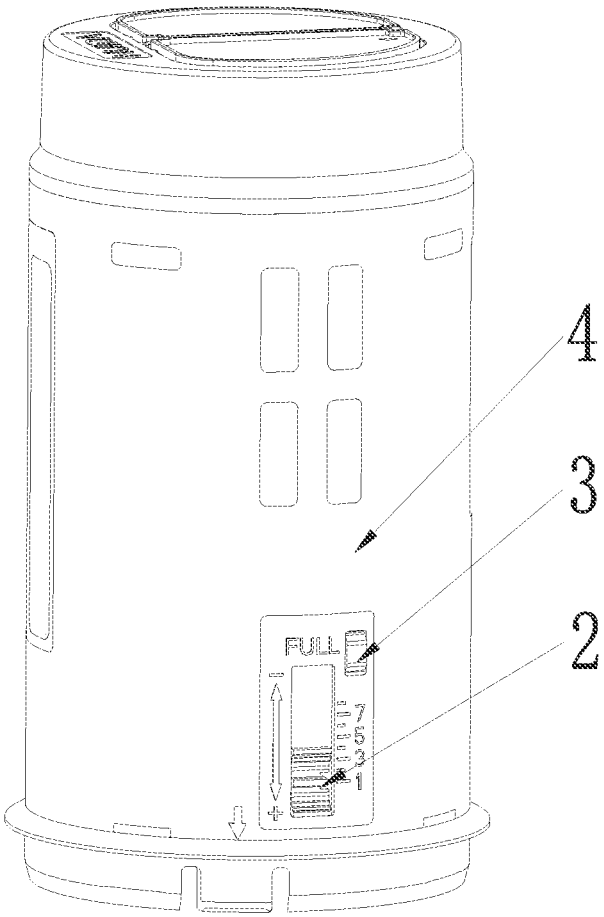
FIG. 3 is a schematic diagram of a self-locking water level adjusting mechanism of the present disclosure shown in a configuration of use.
Figure 4:
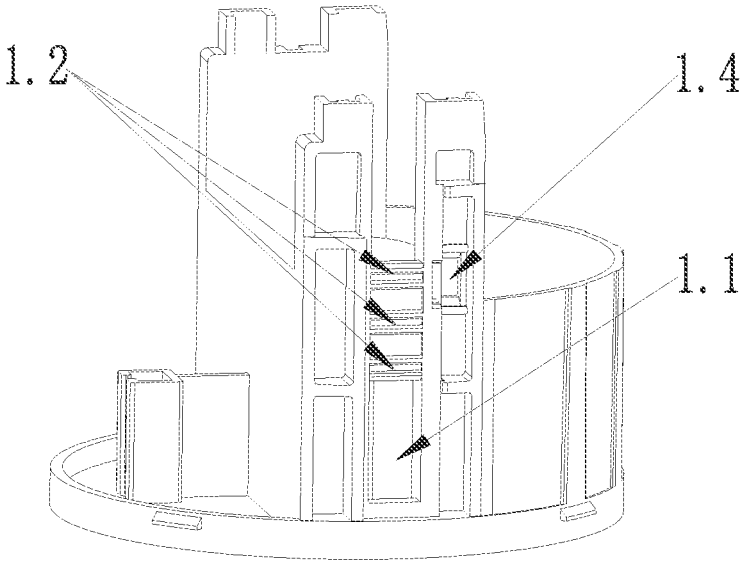
FIG. 4 is a perspective schematic diagram of a partition plate of the present disclosure.
Figure 5:
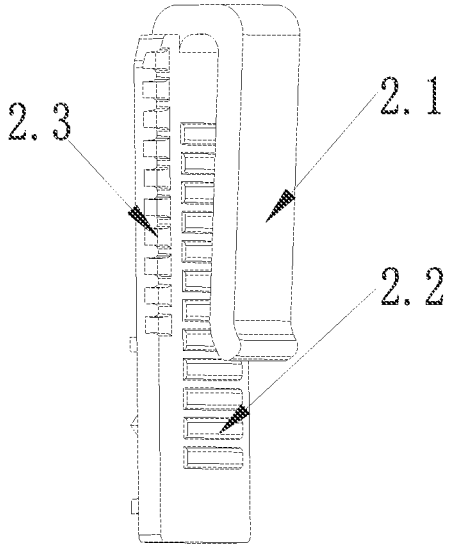
FIG. 5 is a perspective schematic diagram of an adjusting clamping structure of the present disclosure.
Figure 6:
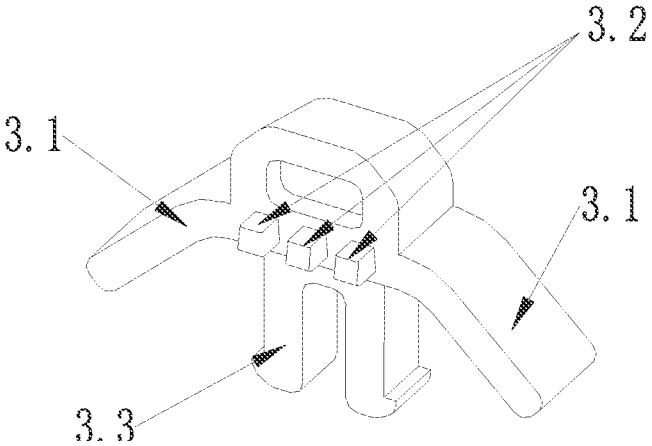
FIG. 6 is a perspective schematic diagram of an adjusting lock of the present disclosure.
Figure 7:
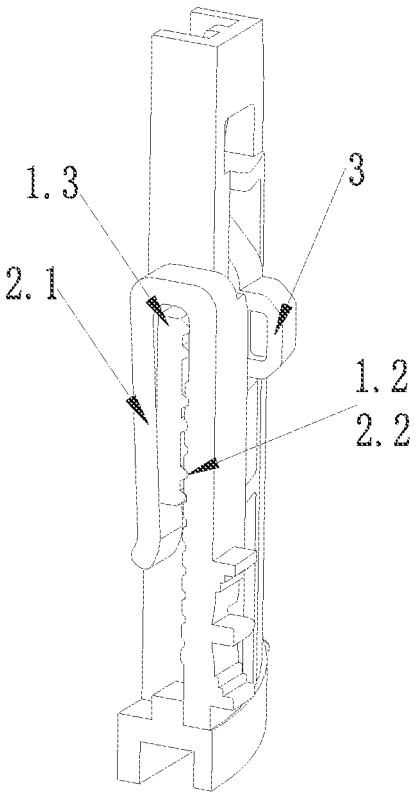
FIG. 7 is a perspective schematic diagram showing a mounting position of the adjusting clamping structure of the present disclosure.
Figure 8:
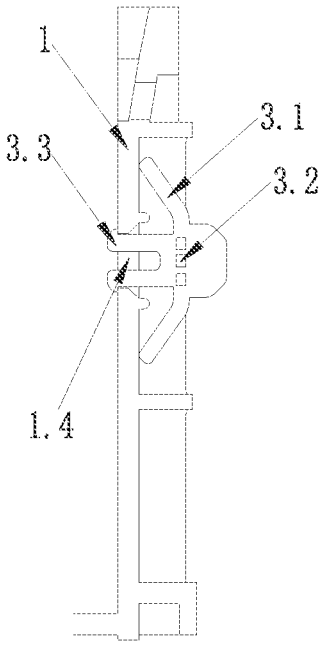
FIG. 8 is a side schematic diagram showing a mounting position of the adjusting lock of the present disclosure.
Figure 9:
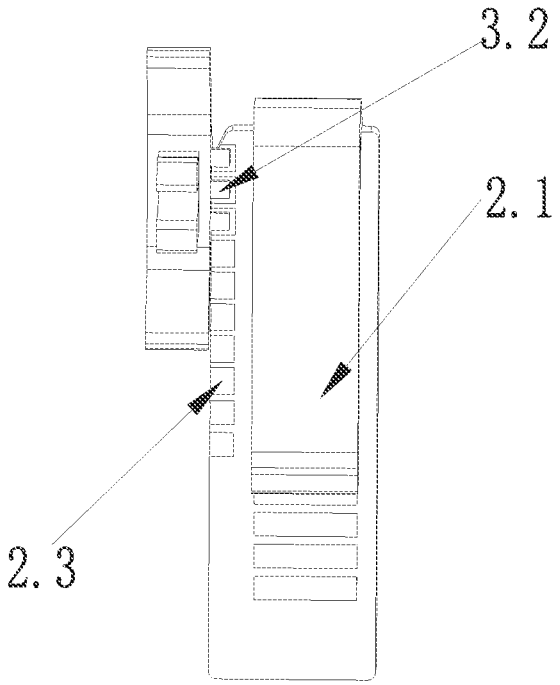
FIG. 9 is a front schematic diagram showing a connection position of the adjusting clamping structure and the adjusting lock of the present disclosure.

As shown in FIGS. 2-9, the present disclosure provides a self-locking water level adjusting mechanism. The self-locking water level adjusting mechanism comprises a partition plate 1, an adjusting clamping structure 2 arranged on one side of the partition plate 1, and an adjusting lock 3. The adjusting clamping structure 2 is slidably connected with the partition plate 1 in a vertical direction. In the embodiment, a handheld surface is defined on a lower portion of an outer surface of the adjusting clamping structure, enabling a user to push the adjusting clamping structure 2. The adjusting lock 3 is elastically connected with the partition plate 1 through an elastic piece. The adjusting lock 3 is clamped with the adjusting clamping structure 2 under restoring force of the elastic piece.

A structure design of the self-locking water level adjusting mechanism of the present disclosure is scientific and reasonable, making it easy to operate and stable in performance. In absence of external force, the adjusting lock 3 and the adjusting clamping structure 2 are in a locked state, so that the adjusting clamping structure 2 is always in a predetermined position and is unable to be released from the adjusting lock 3 to slide, avoiding displacement of the adjusting clamping structure 2 during non-manipulated use, work, and transportation, and ensuring that a drainage volume of a drain valve does not change.

Optionally, in one embodiment, the partition plate 1 comprises a vertical plate 1.3. The vertical plate defines a drainage hole 1.1. The vertical plate 1.3 defines clamping grooves 1.2 above the drainage hole 1.1. The adjusting clamping structure 2 is of a U-shaped structure. The adjusting clamping structure 2 comprises an adjusting plate and an elastic arm 2.1. The adjusting plate and the elastic arm 2.1 are integrally formed. Sliding buckles 2.2 are arranged on an inner wall of the adjusting plate along the vertical direction. The sliding buckles 2.1 of the adjusting plate are clamped in the clamping grooves 1.2 under restoring force of the elastic arm 2.1. In the embodiment, the elastic piece comprises two elastic sheets 3.1 arranged opposite to each other. A first end of each of the elastic sheets 3.1 is fixedly connected with the adjusting lock 3. A second end of each of the elastic sheets 3.1 abuts against a corresponding side of a fixed hole of the vertical plate 1.3. In the embodiment, the adjusting clamping structure 2 comprises clamping teeth 2.3 arranged along the vertical direction. The adjusting lock 3 comprises locking teeth 3.2 matched with a shape of the clamping teeth 2.3. The locking teeth 3.2 of the adjusting lock 3 is engaged with the clamping teeth 2.3 of the adjusting clamping structure 2 under the restoring force of the elastic piece.

Optionally, in one embodiment, the vertical plate 1.3 defines the fixed hole. The adjusting lock 3 comprises two clamping buckles 3.3 arranged opposite to each other. The clamping buckles 3.3 are snapped on a position of the fixed hole, so the adjusting lock 3 is connected with the vertical plate 1.3. In the embodiment, the two clamping buckles 3.3 are clamped with the vertical plate 1.3 of the partition plate 1, avoiding the adjusting lock 3 from separating from the fixed hole 1.4 of the partition plate 1.

A working principle of the present disclosure is as follows.

In the absence of external force on the adjusting lock 3, or the external force is unable to completely separate the locking teeth 3.2 of the adjusting lock 3 from the clamping teeth 2.3 of the adjusting clamping structure 2, the adjusting lock 3 and the adjusting clamping structure 2 are always in the locked state. That is, the adjusting clamping structure is unable to slide on the partition plate 1. A position of the adjusting clamping structure 2 with respect to the fixed hole is fixed, which effectively avoids a change of the position of the adjusting clamping structure 2 caused by transportation, and thus ensuring that the drainage volume of the drain valve does not change.

When the drainage volume needs to be adjusted, the external force is applied on the adjusting lock 3 toward an inner side of the partition plate, so that the adjusting lock 3 moves inward under action of the external force. During inward movement of the adjusting lock 3, the two elastic sheets 3.1 of the adjusting lock 3 undergo elastic deformation and generate elastic potential energy. During the inward movement of the adjusting lock 3, the locking teeth 3.2 move away from the clamping teeth 2.3 of the adjusting clamping structure 2. When the adjusting lock 3 moves to a predetermined position under the action of the external force. The locking teeth 3.2 completely separate from the clamping teeth 2.3 of the adjusting clamping structure 2. That is, the adjusting lock 3 and the adjusting clamping structure 2 are in a separated state.

Keeping the external force applied on the adjusting lock 3 unchanged, downward/upward external force is applied on the adjusting clamping structure 2 to adjust an area of the drainage hole and thereby adjusting the drainage volume. In a sliding process of the adjusting clamping structure 2, the sliding buckles 2.2 arranged on the adjusting clamping structure 2 move away from the elastic arm 2.1. That is, the elastic arm 2.1 of the adjusting clamping structure 2 undergoes elastic deformation. When each of the sliding buckles 2.2 of the adjusting clamping structure 2 slides to a topmost end of a corresponding clamping groove 1.2 of the partition plate 1, the sliding buckles 2.2 do not contact the clamping grooves 1.2. Under the action of the restoring force of the elastic arm 2.1, the sliding buckles 2.2 move into the clamping grooves 1.2. Then continuing to apply the downward/upward external force on the adjustment clamping plate 2, so that the sliding buckles 2.2 of the adjusting clamping structure 2 repeatedly slide out and slide into the clamping grooves 1.2 of the partition plate 1. Stuttering sensation generated in a slide out and snap in process of the sliding buckles 2.2 allows an operator to clearly feel the change in position of the adjusting clamping structure 2.

When the adjusting clamping structure 2 is adjusted to a desired position, the downward/upward external force applied to the adjusting clamping structure 2 and the external force applied to the adjusting lock 3 are removed, and the adjusting clamping structure 2 stops in a fixed position, the elastic sheets 3.1 of the adjusting lock 3 store a certain elastic potential energy under the action of the external force and undergo elastic deformation. When the external force is not applied on the adjusting clamping structure 2 anymore, the elastic sheets 3.1 of the adjusting lock 3 start to restore, driving the adjusting lock 3 to move outward, so the locking teeth 3.2 of the adjusting lock 3 move close to the clamping teeth 2.3 of the adjusting clamping structure 2. When the elastic sheets 3.1 of the adjusting lock 3 completely restore to an initial state, the locking teeth 3.2 are completely engaged with the clamping teeth 2.3 of the adjusting clamping structure 2. Namely, the adjusting clamping structure and the adjusting lock 3 are in the locked state.

If there is only the external force applied on the adjusting clamping structure 2, since the locking teeth 3.2 of the adjusting lock 3 are engaged with the clamping teeth 2.3 of the adjusting clamping structure 2 when no external force is applied on the adjusting lock 3, and the adjusting lock 3 is fixed to the partition plate 1, the position of the adjusting clamping structure 2 with respect to the partition plate 1 is fixed, which avoids the displacement of the adjusting clamping structure during non-manipulated use, work, and transportation.

Optionally, in one embodiment, a vertical cross-section of each of the clamping grooves 1.2 and a vertical cross-section of each of the sliding buckles 2.2 are trapezoidal. The clamping grooves 1.2 and the sliding buckles 2.2 both include inclined surfaces. The inclined surfaces of the clamping grooves are matched with the inclined surfaces of the sliding buckles 2.2. In the embodiment, an angle between each of the inclined surfaces of the clamping grooves 1.2 and a vertical plane is greater than 90 degrees. An angle between each of the inclined surfaces of the sliding buckles 2.2 and the vertical plane is greater than 90 degrees. Each of the clamping grooves 1.2 of the partition plate 1 is configured to be a slope greater than 90 degrees, so each of the sliding buckles 2.2 of the adjusting clamping structure 2 slides along the slope of a corresponding clamping groove of the partition plate 1 under the action of external force.

Optionally, in one embodiment, an upper frame 4 is sleeved on the partition plate 1. The upper frame 4 defines an adjusting opening corresponding to a position of the adjusting clamping structure and a locking opening corresponding to a position of the adjusting lock 3. An outer end of the adjusting lock 3 passes through the locking opening and extends outward. A distance between the outer end of the adjusting lock 3 and an outer surface of the upper frame 4 is less than a depth of each of the clamping teeth 2.3. If the adjusting lock 3 moves inward due to compression of other objects, since the distance between the outer end of the adjusting lock 3 and the outer surface of the upper frame 4 is less than the depth of each of the clamping teeth 2.3 (i.e., a height of the adjusting lock 3 exceeding the upper frame 4 is less than a distance required for the locking teeth 3.2 of the adjusting lock 3 to completely disengage from the clamping teeth 2.3 of the adjusting clamping structure 2), the adjusting lock is unable to move inward due to limitation of the upper frame 4. At this time, the locking teeth 3.2 are still engaged with the clamping teeth 2.3 of the adjusting clamping structure 2, which avoids the adjusting lock 3 from unlocking with the adjusting clamping structure 2 and effectively avoids the displacement of the adjusting clamping structure with respect to the drainage hole during transportation or under the external force.

The structure design of the self-locking water level adjusting mechanism of the present disclosure is scientific and reasonable, making it easy to operate and stable in performance. In the absence of external force, the adjusting lock and the adjusting clamping structure are in the locked state, so that the adjusting clamping structure is always in the predetermined position and is unable to be released from the adjusting lock to slide, avoiding the displacement of the adjusting clamping structure during non-manipulated use, work, and transportation, and ensuring that the drainage volume of the drain valve does not change.

The above are only the optional embodiments of the present disclosure. It should be pointed out that for those of ordinary skill in the art, improvements can be made without departing from the principle of the present disclosure, and these improvements fall within the protection scope of the present disclosure.

What is claimed is:

1. A self-locking water level adjusting mechanism, comprising: a partition plate, an adjusting clamping structure arranged on one side of the partition plate, and an adjusting lock; the adjusting clamping structure is slidably connected with the partition plate in a vertical direction; the adjusting lock is elastically connected with the partition plate through an elastic piece; the adjusting lock is clamped with the adjusting clamping structure under restoring force of the elastic piece.

2. The self-locking water level adjusting mechanism according to claim 1, wherein the partition plate comprises a vertical plate; the vertical plate defines a drainage hole; the vertical plate defines clamping grooves above the drainage hole; the adjusting clamping structure is of a U-shaped structure; the adjusting clamping structure comprises an adjusting plate and an elastic arm; the adjusting plate and the elastic arm are integrally formed; sliding buckles are arranged on an inner wall of the adjusting plate along the vertical direction; the sliding buckles of the adjusting plate are clamped in the clamping grooves under restoring force of the elastic arm.

3. The self-locking water level adjusting mechanism according to claim 2, wherein the vertical plate defines a fixed hole; the adjusting lock comprises two clamping buckles arranged opposite to each other; the clamping buckles are snapped on a position of the fixed hole, so the adjusting lock is connected with the vertical plate.

4. The self-locking water level adjusting mechanism according to claim 3, wherein the elastic piece comprises two elastic sheets arranged opposite to each other; a first end of each of the elastic sheets is fixedly connected with the adjusting lock, and a second end of each of the elastic sheets abuts against a corresponding side of the fixed hole of the vertical plate.

5. The self-locking water level adjusting mechanism according to claim 2, wherein the adjusting clamping structure comprises clamping teeth arranged along the vertical direction; the adjusting lock comprises locking teeth matched with a shape of the clamping teeth; the locking teeth of the adjusting lock is engaged with the clamping teeth of the adjusting clamping structure under the restoring force of the elastic piece.

6. The self-locking water level adjusting mechanism according to claim 2, wherein a vertical cross-section of each of the clamping grooves and a vertical cross-section of each of the sliding buckles are trapezoidal; the clamping grooves and the sliding buckles define inclined surfaces; the inclined surfaces of the clamping grooves are matched with the inclined surfaces of the sliding buckles.

7. The self-locking water level adjusting mechanism according to claim 6, wherein an angle between each of the inclined surfaces of the clamping grooves and a vertical plane is greater than 90 degrees; an angle between each of the inclined surfaces of the sliding buckles and the vertical plane is greater than 90 degrees.

8. The self-locking water level adjusting mechanism according to claim 5, wherein an upper frame is sleeved on the partition plate; the upper frame defines an adjusting opening corresponding to a position of the adjusting clamping structure and a locking opening corresponding to a position of the adjusting lock.

9. The self-locking water level adjusting mechanism according to claim 8, wherein an outer end of the adjusting lock passes through the locking opening and extends outward; a distance between the outer end of the adjusting lock and an outer surface of the upper frame is less than a depth of each of the clamping teeth.

10. The self-locking water level adjusting mechanism according to claim 1, wherein a handheld surface is defined on a lower portion of an outer surface of the adjusting clamping structure.

* * * * *